US008312858B2

(12) United States Patent
McClave et al.

(10) Patent No.: US 8,312,858 B2
(45) **Date of Patent: *Nov. 20, 2012**

(54) SYSTEM AND METHOD FOR LUBRICATING POWER TRANSMITTING ELEMENTS

(75) Inventors: Peter J. McClave, Elkhart Lake, WI (US); George A. Jankuski, Glenbeulah, WI (US); Laura K. Mueller, Fond du Lac, WI (US)

(73) Assignee: Kohler Co., Kohler, WI (US)

( * ) Notice: Subject to any disclaimer, the term of this patent is extended or adjusted under 35 U.S.C. 154(b) by 1050 days.

This patent is subject to a terminal disclaimer.

(21) Appl. No.: 12/189,426

(22) Filed: Aug. 11, 2008

(65) Prior Publication Data

US 2009/0000871 A1 Jan. 1, 2009

Related U.S. Application Data

(63) Continuation-in-part of application No. 11/615,411, filed on Dec. 22, 2006, now Pat. No. 7,431,006.

(51) Int. Cl.
*F01M 11/02* (2006.01)

(52) U.S. Cl. ..... 123/196 R; 184/6.12; 184/11.1; 184/13.1; 184/6

(58) Field of Classification Search ..... 123/196 R; 184/6.12, 11.1, 13.1, 6
See application file for complete search history.

(56) References Cited

U.S. PATENT DOCUMENTS 3,301,349 A 1/1967 Williams
3,621,937 A 11/1971 Edge et al.
3,635,048 A 1/1972 Monti
4,771,864 A 9/1988 Lorimor et al.
5,052,518 A 10/1991 Trommer
5,119,905 A 6/1992 Murray (Continued)

FOREIGN PATENT DOCUMENTS

EP 1536154 A2 6/2005

(Continued)

OTHER PUBLICATIONS

Notification of Transmittal of the International Search Report and the Written Opinion of the International Searching Authority, International Search Report; Written Opinion of the International Searching Authority; dated Oct. 29, 2009; 13 pages.

(Continued)

*Primary Examiner* — Nathaniel Wiehe
*Assistant Examiner* — James Kim
(74) *Attorney, Agent, or Firm* — Whyte Hirschboeck Dudek S.C.

(57) ABSTRACT

A lubrication system and method are disclosed. The system includes a main engine bearing and a crankshaft in operational association with the bearing. The crankshaft includes an end having a cavity with a power transmitting element (e.g., splines). The cavity can receive and engage a mating mechanism to transmit power thereto. The crankshaft further includes a first oil passage that is disposed within the end and a second oil passage that extends from the main engine bearing into the crankshaft. The first oil passage intersects the second oil passage. The system can also include a pump mechanism for circulating lubricating oil from the main engine bearing to the crankshaft through the second oil passage and the first oil passage, and to the cavity to lubricate the power transmitting element. During engine operation, a constant supply of lubricating oil can be provided to the power transmitting element to reduce component wear.

30 Claims, 7 Drawing Sheets

U.S. PATENT DOCUMENTS

| | | | | |
|---|---|---|---|---|
| 5,687,612 | A | 11/1997 | Imamura | |
| 6,183,230 | B1 | 2/2001 | Beardmore | |
| 6,192,853 | B1 | 2/2001 | Natsume | |
| 6,196,207 | B1 | 3/2001 | Megas | |
| 6,736,023 | B1 | 5/2004 | Sumi et al. | |
| 7,143,734 | B1 * | 12/2006 | Leppanen et al. | 123/192.1 |
| 7,204,241 | B2 | 4/2007 | Thompson et al. | |
| 7,431,006 | B2 * | 10/2008 | Jankuski | 123/196 R |
| 7,510,064 | B2 * | 3/2009 | Graves | 192/85.42 |
| 2002/0046743 | A1 | 4/2002 | Moren | |
| 2004/0103872 | A1 * | 6/2004 | Ronneburger et al. | 123/196 R |
| 2005/0016491 | A1 * | 1/2005 | Leiber et al. | 123/197.4 |
| 2006/0027198 | A1 * | 2/2006 | Plenzler et al. | 123/90.34 |
| 2008/0149423 | A1 | 6/2008 | Jankuski | |

FOREIGN PATENT DOCUMENTS

| | | | |
|---|---|---|---|
| FR | 2839750 | A1 | 11/2003 |
| FR | 2877702 | A | 5/2006 |
| GB | 191327545 | A | 0/1914 |
| GB | 1322315 | | 7/1973 |
| GB | 2384160 | A | 7/2003 |
| JP | 2001303920 | | 10/2001 |
| WO | 9964728 | A1 | 12/1999 |
| WO | 2007116294 | | 10/2007 |

OTHER PUBLICATIONS

PCT/US2009/004383; Notification Concerning Transmittal of International Preliminary Report on Patentability (Chapter I of the Patent Cooperation Treaty); Feb. 24, 2011; 8 pages.

* cited by examiner

SYSTEM AND METHOD FOR LUBRICATING POWER TRANSMITTING ELEMENTS

CROSS-REFERENCE TO RELATED APPLICATIONS

This Continuation-in-Part Patent Application claims the benefit of U.S. patent application Ser. No. 11/615,411 filed Dec. 22, 2006, which is incorporated herein by reference.

STATEMENT REGARDING FEDERALLY SPONSORED RESEARCH OR DEVELOPMENT

Not Applicable

FIELD OF THE INVENTION

The present invention relates to a lubrication system, and more particularly, to a system and method for lubricating power transmitting elements. In one aspect, the invention relates to a spline lubrication system.

BACKGROUND OF THE INVENTION

Without proper lubrication to flush away or otherwise remove contaminants, power transmitting elements in engines progressively wear during use. Such wear results in decreased service life of a given piece of equipment. For example, a typical engine with a crankshaft employing internal splines may have a desired service life of 1500 hours. However, during engine use, the slight relative movement between the internal splines and the complementary external splines of an additional component engaged with the internal splines results in fretting and/or corrosion on the splines such that routine maintenance may be required after only 500 hours of use, or perhaps even less. Further, the fretting and/or corrosion of the splines may be exacerbated by improper alignment of the internal splines and the complementary external splines of an additional component.

Accordingly, it would be desirable to provide a system and method for lubricating power-transmitting elements, such as splines, to reduce wear and to increase service life of such elements during use. Such a solution would, advantageously, reduce the amount of time and costs associated with maintaining equipment incorporating such power transmitting elements.

BRIEF SUMMARY OF THE INVENTION

In one aspect, the present invention relates to a lubrication system for lubricating a power transmitting element in an engine. The system includes a main engine bearing and a crankshaft in operational association with the main engine bearing. The crankshaft includes an end having a cavity having a power transmitting element, and the cavity is capable of receiving and engaging a mating mechanism so as to transmit power thereto. The crankshaft further includes a first oil passage that is substantially centrally disposed within the end and a second oil passage that extends from a main engine bearing into the crankshaft such that the first oil passage intersects the second oil passage. Lubricating oil is circulated from the main engine bearing to the crankshaft through the second oil passage and the first oil passage, and then to the cavity so as to lubricate the power transmitting element. In at least some embodiments, the power transmitting element can include splines or a splined surface. Still further, and in accordance with at least some embodiments, the system can include an engine closure and adapter device. In some embodiments, this device can further include an adapter plate secured to an engine closure plate. In other embodiments, the device includes integrally formed engine closure plate and adapter plate portions, with the engine closure and adapter device being capable of interfacing with another mechanism.

In other aspects, other systems and methods for lubricating one or more power transmitting elements in an engine are also disclosed.

Advantageously, during engine operation, a constant or substantially constant supply of lubricating oil can be provided to the power transmitting element so as to reduce component wear and, desirably, extend component service life.

BRIEF DESCRIPTION OF THE DRAWINGS

Embodiments of the invention are disclosed with reference to the accompanying drawings and are for illustrative purposes only. The invention is not limited in its application to the details of construction or the device of the components illustrated in the drawings. The invention is capable of other embodiments or of being practiced or carried out in other various ways. Like reference numerals are used to indicate like components. In the drawings.

DETAILED DESCRIPTION OF THE PREFERRED EMBODIMENTS

Figure 1:
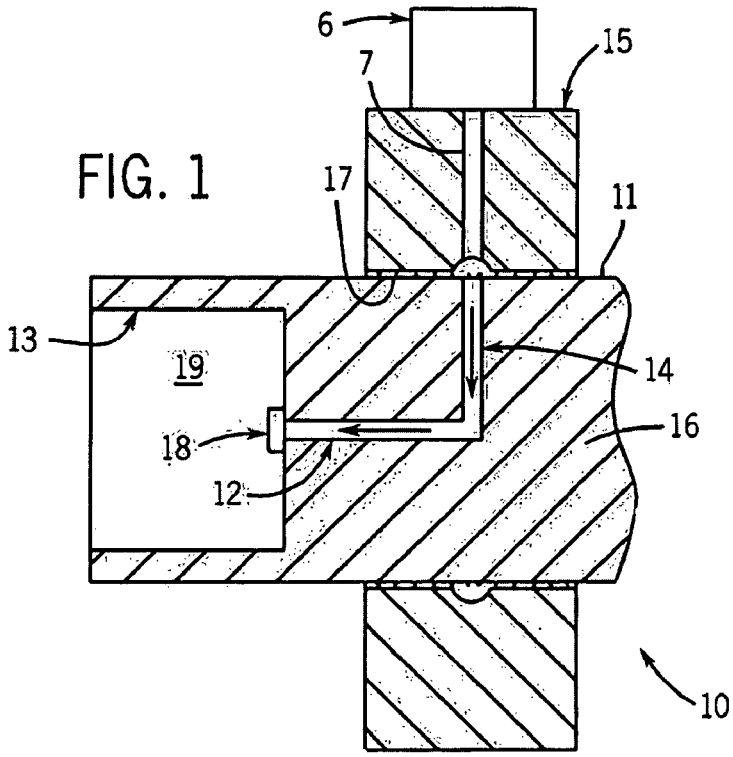
FIG. 1 is a schematic illustration of one embodiment of a system for lubricating a power transmitting element on an engine crankshaft according to one aspect of the present invention.

FIG. 1 is a schematic illustration of one embodiment of a system 10 for lubricating a power transmitting element, such as a spline, a keyway, and the like, via an engine crankshaft 16 in accordance with at least one aspect of the present invention. A first oil passage 12 is provided in the center of an end 11 of the crankshaft 16. As shown, and in accordance with at least one embodiment of the present invention, the end 11 is the Power Take-Off (PTO) end of the crankshaft 16. It is contemplated and considered within the scope of the present invention, however, that another location on the crankshaft 16 may be used, including by way of example, the end opposite the PTO end 11. The PTO end 11 includes a cavity 19 with a surface 13 that includes the power-transmitting element(s). The cavity 19 is capable of receiving an additional mechanism (not shown) that is capable of contacting or engaging the power transmitting element used in conjunction with surface 13. A second oil passage 14 is provided that extends, as shown, radially inward into the crankshaft 16 from a main engine bearing 15 (e.g., a rear main engine bearing). The first oil passage 12 intersects the second oil passage 14.

Lubricating oil 17, circulated to the bearing 15 by means of an existing engine oil pump or pumping mechanism 6, flows via a bearing passage 7 through the bearing 15, through the second oil passage 14 to the first oil passage 12, and then to the center of the cavity 19. A flow reducing orifice 18 is provided, typically in the first oil passage 12, to control the flow of lubricating oil 17 to the cavity 19. The lubricating oil 17 arriving at or near the center of the cavity 19 can then proceed outward to the inwardly-facing surface 13, and thus can eventually be used to lubricate both the surface 13 having the power-transmitting element (again not shown) and any additional component that is inserted into the cavity 19. In this fashion, a constant supply of lubricating oil 17 is provided to the power transmitting element to flush away contaminant(s) contained therein or thereon during operation of the engine.

In at least some embodiments, in addition to the lubricating oil 17 being provided to the power transmitting element (e.g., an internal spline), as well as any interfacing element (e.g., a complementary external spline), it is possible that the lubricating oil 17 can also be further communicated to other devices by way of such additional components as are coupled to the crankshaft (e.g., PTO end) 16 by way of the power transmitting elements. For example, if an additional component having an interfacing element (e.g., an external spline) also included a clutching mechanism (e.g., a multiple disc hydraulic actuated clutch), then pressurized oil could be supplied from the center of the cavity 19 (as provided by the first oil passage 12) to a receiving passage within the external spline and subsequently to the clutching mechanism.

Figure 2:
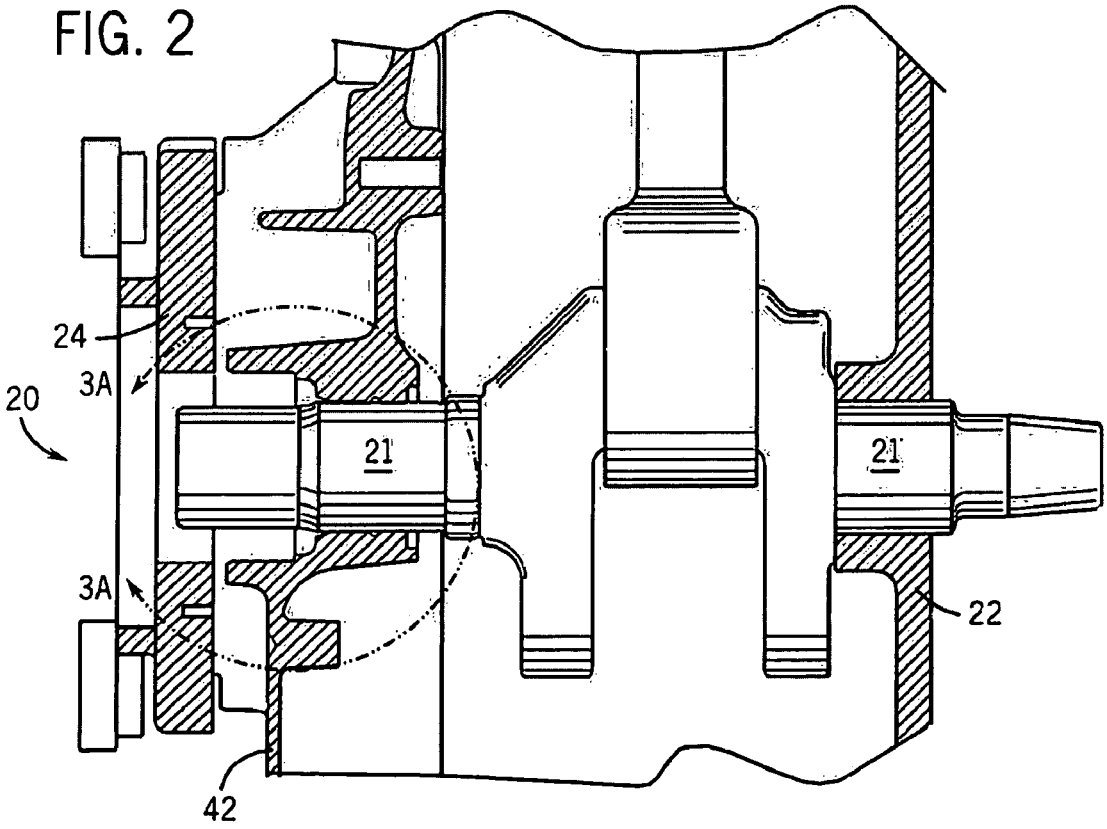
FIG. 2 is a sectional view of one embodiment of a Power Take-Off (PTO) end of an internally splined engine crankshaft in accordance with one aspect of the present invention.

Turning to FIG. 2 and in accordance with one aspect of the present invention, a sectional view of another embodiment of a PTO end 20 of an internally splined engine crankshaft 21 is shown. The crankshaft 21 is rotatively supported, as shown via a crankcase 22. An adapter plate 24 is also shown. Further, it is contemplated that, while not shown, a pump, (e.g., a hydraulic pump), can be and typically is secured to the adapter plate 24. This pump can be used to operate hydraulically powered equipment, for example, a log splitter, a digging apparatus or a utility boom. An engine closure plate 42 is also shown and is described further with respect to FIGS. 3A and 3B. As noted above, the end 20 is the PTO end of the crankshaft 21. However, it is again contemplated that, in at least some embodiments of the present invention, lubrication can be accomplished at another location on the crankshaft 21, including by way of example, the end opposite the PTO end 20.

Figure 3A:
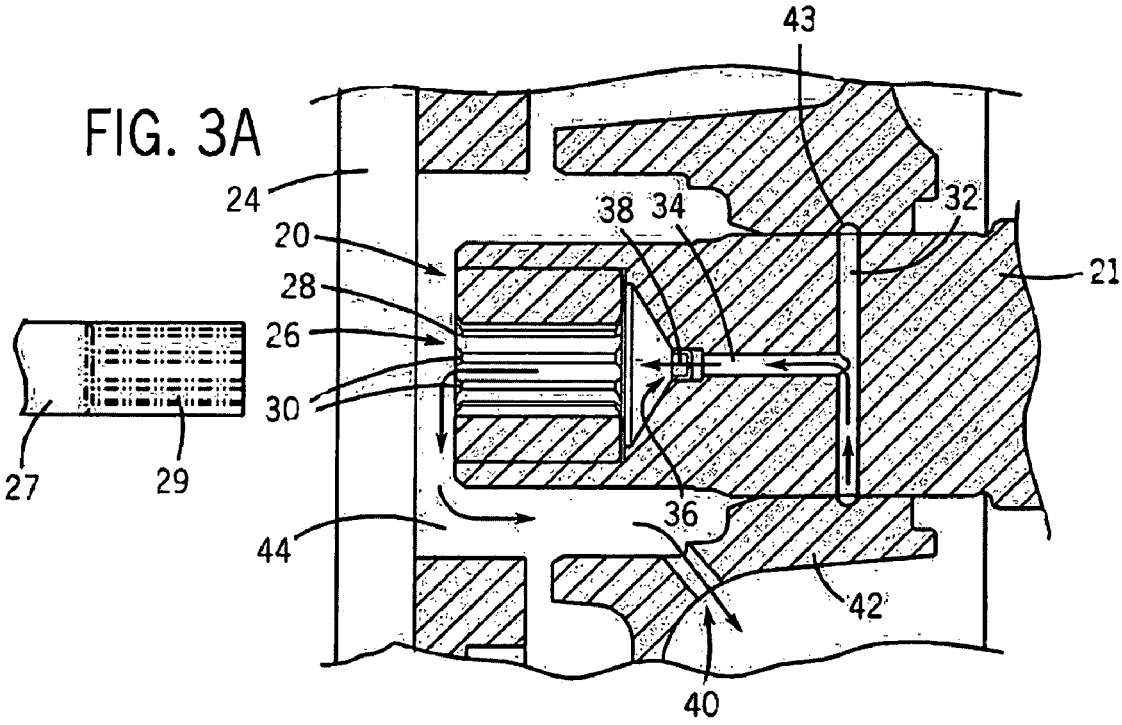
FIG. 3A is an enlarged detailed sectional view of FIG. 2 showing spline lubrication in accordance with at least one aspect of the present invention.

FIG. 3A is an enlarged detailed sectional view of FIG. 2. The internally splined engine crankshaft 21, supported by the crankcase 22 (FIG. 2) is again shown. The end 20 includes a cavity 26 with a surface 28 that includes internal splines 30 (or spline teeth). FIG. 3A also illustrates an exemplary mating mechanism 27 (i.e. an additional component) having an interfacing element 29 (e.g., spline(s)). The cavity 26 is capable of receiving the interfacing element 29 that, in accordance with at least some embodiments, is capable of contacting and/or engaging the internal splines 30 of surface 28.

Further referring to FIG. 3A, the bearing 15 includes an annular channel 43 and can be fully or partially formed therein. Further, the annular channel 43 is disposed circumferentially about the crankshaft 21A. The annular channel 43 provides oil to a second oil passage 32 that extends radially inward into the crankshaft 21. A first oil passage 34, adjacent to cavity 26, intersects the second oil passage 32. The first oil passage 34 is provided at or around the center of the crankshaft 21. In one embodiment, first and second oil passages 34, 32 are created by drilling the passages into the crankshaft 21, with the second oil passage 32 cross-drilled vertically into the crankshaft 21. It is noted here that while an internally splined engine crankshaft 21 capable of receiving or engaging a mating mechanism 27 having the interfacing element 29 with external splines is discussed, it should be understood that, if desired, such spline patterns may be reversed. For example, the crankshaft may employ an external spline (or other interfacing element) capable of receiving an internal spline (or other interfacing element) of the mating mechanism. Also, as noted above with respect to FIG. 1, while splines are illustrated here, other power-transmitting elements are contemplated and considered within the scope of the present invention. Finally, while the first and second oil passages 34, 32, are shown to intersect each other at approximately a 90 degree angle and at or near the center of the crankshaft 21, other angles and locations are contemplated and considered within the scope of the present invention. The size and specific shape of the passages can also vary to convenience.

Further referring to FIG. 3A, advantageously, a flow reducing orifice 36 is provided, typically in the first oil passage 34, to control the flow of lubricating oil to the cavity 26, and specifically the internal splines 30. As shown, to accomplish the flow-reduction, a plug 38 is included and is situated or otherwise secured within the first oil passage 34. Lubricating oil flows through the plug 38 and into the cavity 26. One plug that is suitable for use in the present invention to control oil flow to the internal splines 30 is Cup Plug, part no. 24 139 05, available from Kohler, Co., located in Kohler, Wis. As further illustrated by the arrows in FIG. 3A, the lubricating oil arriving at the cavity 26 can then proceed to lubricate internal splines 30 of surface 28, as well as any additional component (s) that is inserted into the cavity 26.

Figure 3B:
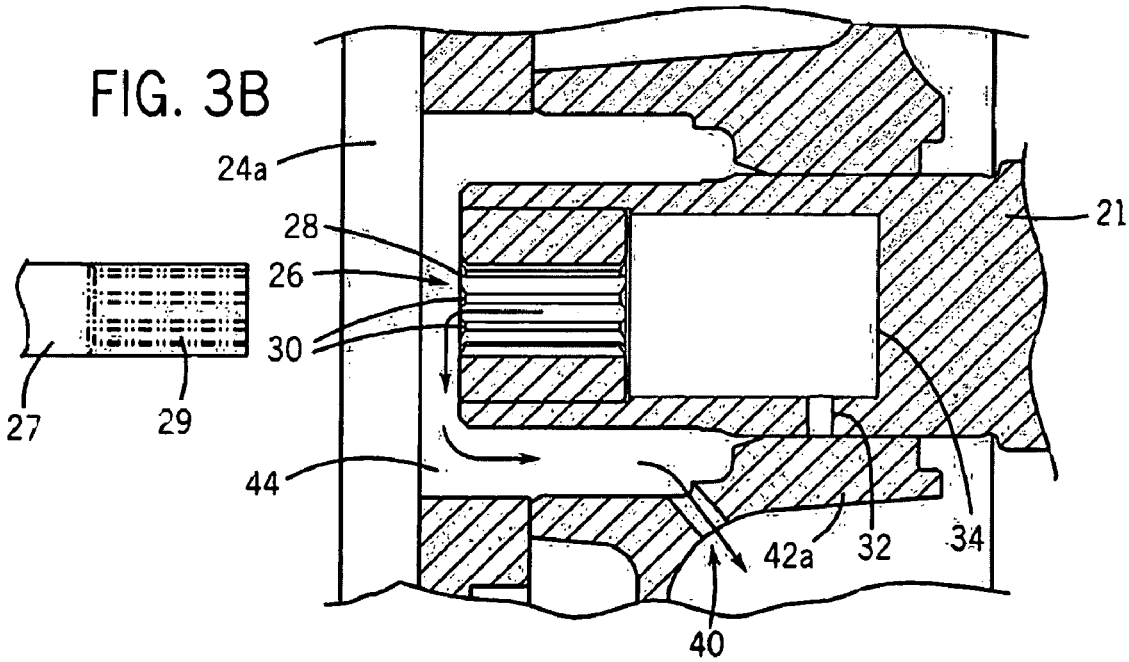
FIG. 3B is another view similar to that of FIG. 3A showing another embodiment of PTO end spline lubrication in accordance with at least some aspects of the present invention.

FIG. 3B is another view similar to that of FIG. 3A, showing spline lubrication in accordance with another aspect of the present invention. More specifically, FIG. 3B depicts an embodiment where the second oil passage 32 receives lubricating oil from the bearing to the first oil passage 34, with the first oil passage 34 provides lubricating oil to the cavity 26, this is accomplished without an annular channel or flow reducing device as discussed above.

Figure 4A:
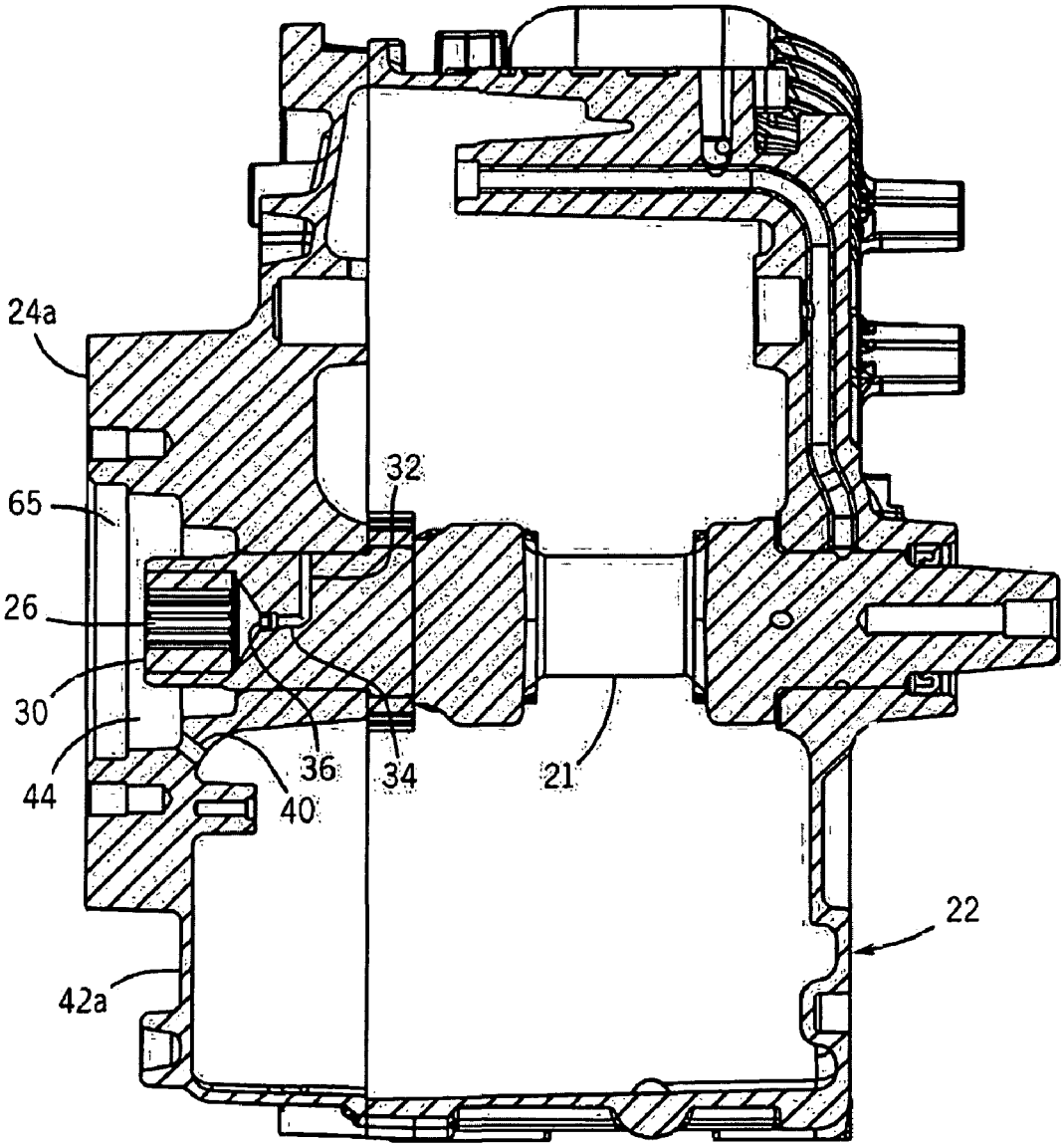
FIG. 4A is a cross-sectional side view of one embodiment of a system for lubricating power transmission elements in accordance with at least one aspect of the invention.
Figure 4B:
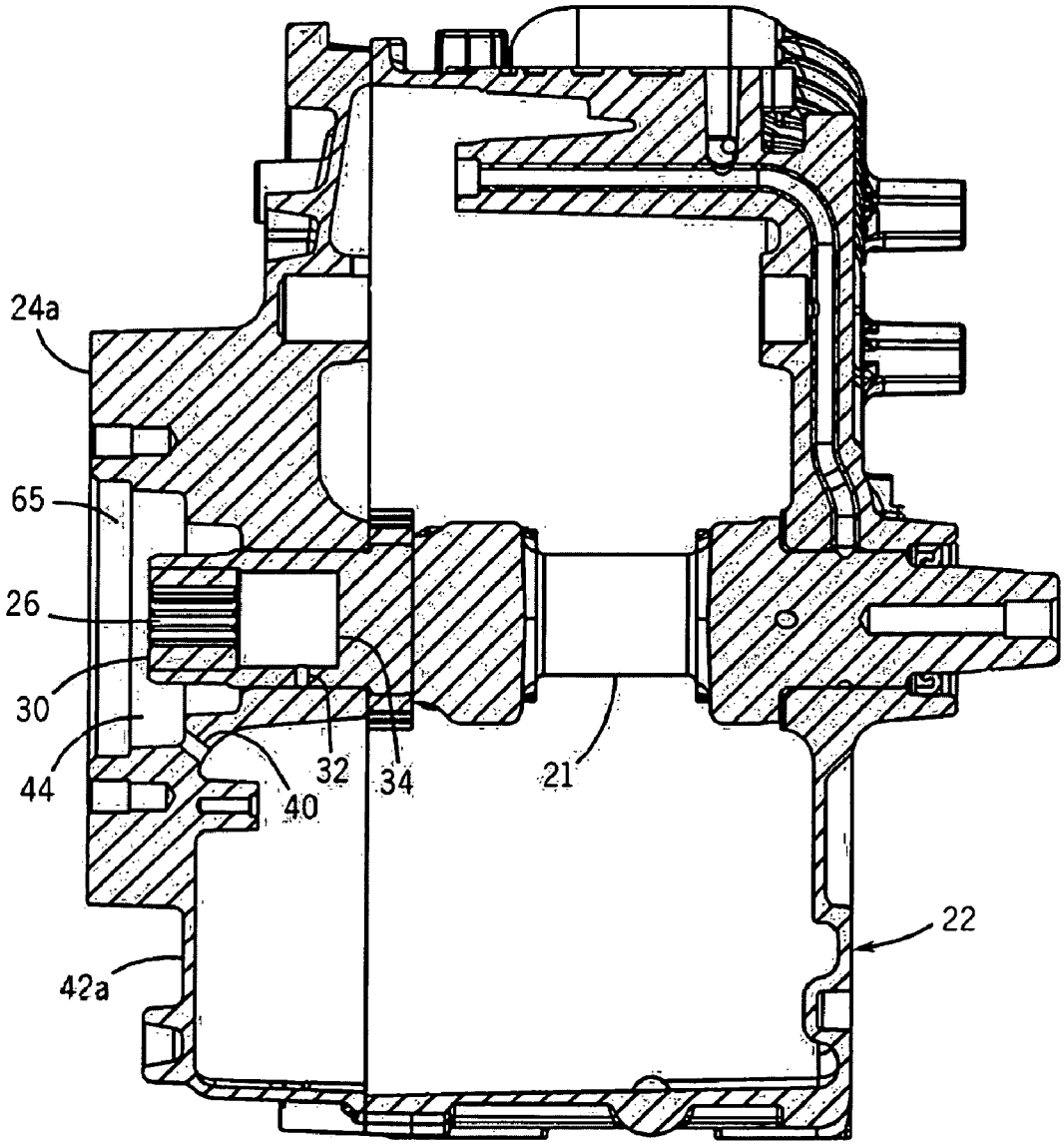
FIG. 4B is a cross-sectional side view of another embodiment of the system for lubricating power transmission elements in accordance with at least some aspects of the invention.

FIG. 4A depicts a cross-sectional side view of one embodiment of a system for lubricating power transmission elements in accordance with at least one aspect of the invention. More specifically, FIG. 4A depicts the crankshaft 21 at least partially situated in a crankcase 22, wherein the crankshaft 21 further includes the first oil passage 34, the second oil passage 32, the flow reducing orifice 36 and the cavity 26. FIG. 4B is a cross-sectional side view of another embodiment of the system for lubricating power transmission elements in accordance with at least some aspects of the invention. More particularly, FIG. 4B shows the crankshaft 21 at least partially situated in the crankcase 22, wherein the crankshaft 21 further includes the first oil passage 34, the second oil passage 32 and the cavity 26.

In contrast to the embodiments shown in FIGS. 3A and 4A, the embodiments shown in FIGS. 3B and 4B do not utilize the flow reducing orifice 36. Instead, lubricating oil flows from the bearing passage 45*a* (see FIG. 5B) through the second and first oil passages 32, 34 respectively, and into the cavity 26. As the crankshaft 21 shown in FIG. 3B rotates, the second oil passage 32 also rotates and aligns with the bearing passage 45*a* shown in FIG. 5B (or, similarly, bearing passage 45 shown in FIG. 5A) once per revolution of the crankshaft 21 for a brief period of time. Further, when no flow reducing orifice is present, the flow of lubricating oil into the cavity 26 is at least partially regulated by the size of the second oil passage 32 and the frequency of rotational alignment of the second oil passage 32 with the bearing passage 45*a* shown in FIG. 5B (or bearing passage 45 shown in FIG. 5A). Additionally, the first oil passage 34 shown in FIGS. 3B and 4B is substantially larger than as shown in FIGS. 3A and 4A. In at least one embodiment, the size of the first oil passage 34 can be considered a manufacturing variation that is intended to simplify the machining process of the crankshaft 21, and in such instances the size may not be critical to the function of the system 10. Still, in other embodiments, the size of the first oil passage may be at least partially dependent on the size of the second oil passage 32 and/or the desired quantity of oil flow to the cavity 26. Moreover no annular channel, such as the annular channel 43 as described above, is required.

Engine crankshafts often include a bearing seal that prevents oil from dripping out of the engine at a PTO end. In the present embodiments, such a seal can be eliminated by use of a passageway 40 and a drain cavity 44. The passageway 40 is drilled or otherwise provided in an engine closure plate 42 (FIG. 3A), or engine closure plate portion 42*a* (FIG. 3B and FIGS. 4A-B). Passageway 40 defines or provides a return oil path by which the lubricating oil 17 is returned from a drain cavity 44. Typically, the lubricating oil flows from the drain cavity 44 to the engine oil pump (not shown), via a crankcase sump (also not shown). In this way, a constant or substantially constant supply of lubricating oil is provided to the cavity 26 so as to remove contaminants during engine operation. In at least one embodiment, the engine closure plate 42 (FIG. 3A) at least partially encloses the power take-off (PTO) end 20. Similarly, engine closure plate portion 42*a* (FIGS. 3B and 4A-B) can partially enclose the power take-off (PTO) end 20. In general, the enclosed space between the engine closure plate 42 (and similarly engine closure plate portion 42*a*) and the PTO end 20 can define or provide for at least a portion of the drain cavity 44.

Figure 5B:
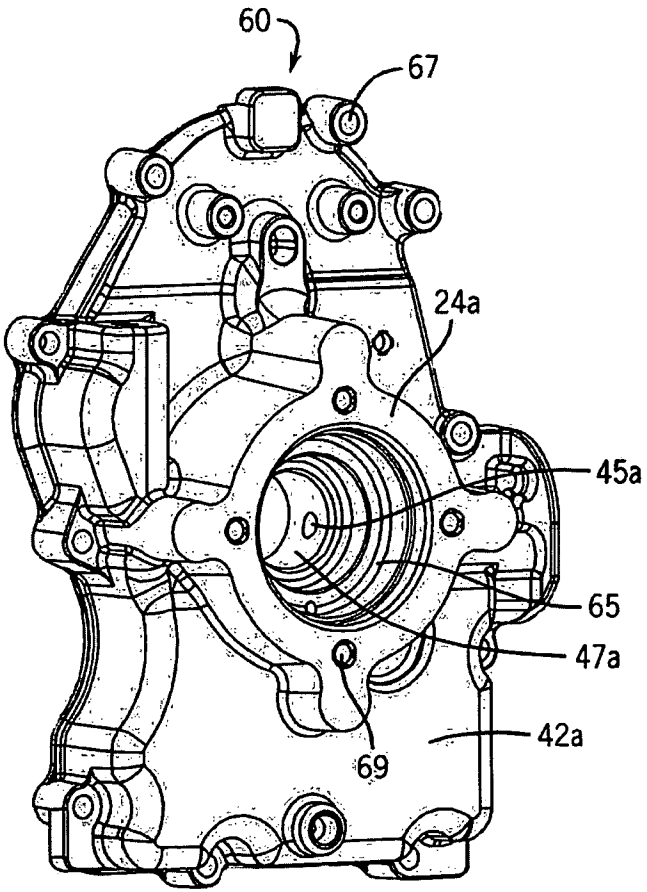
FIG. 5B is a perspective view of another embodiment of the engine closure and adapter device in which the device includes an integrally formed or integrated engine closure plate portion and an adapter plate portion.
Figure 5A:
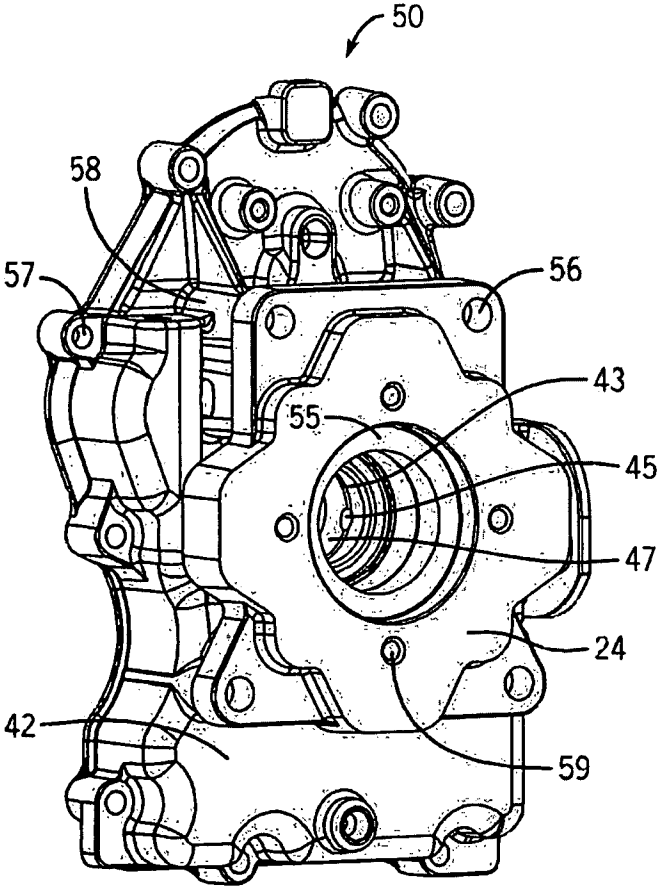
FIG. 5A is a perspective view of an embodiment of an engine closure and adapter device having an engine closure plate with an adapter plate attached thereto.
Figure 5C:
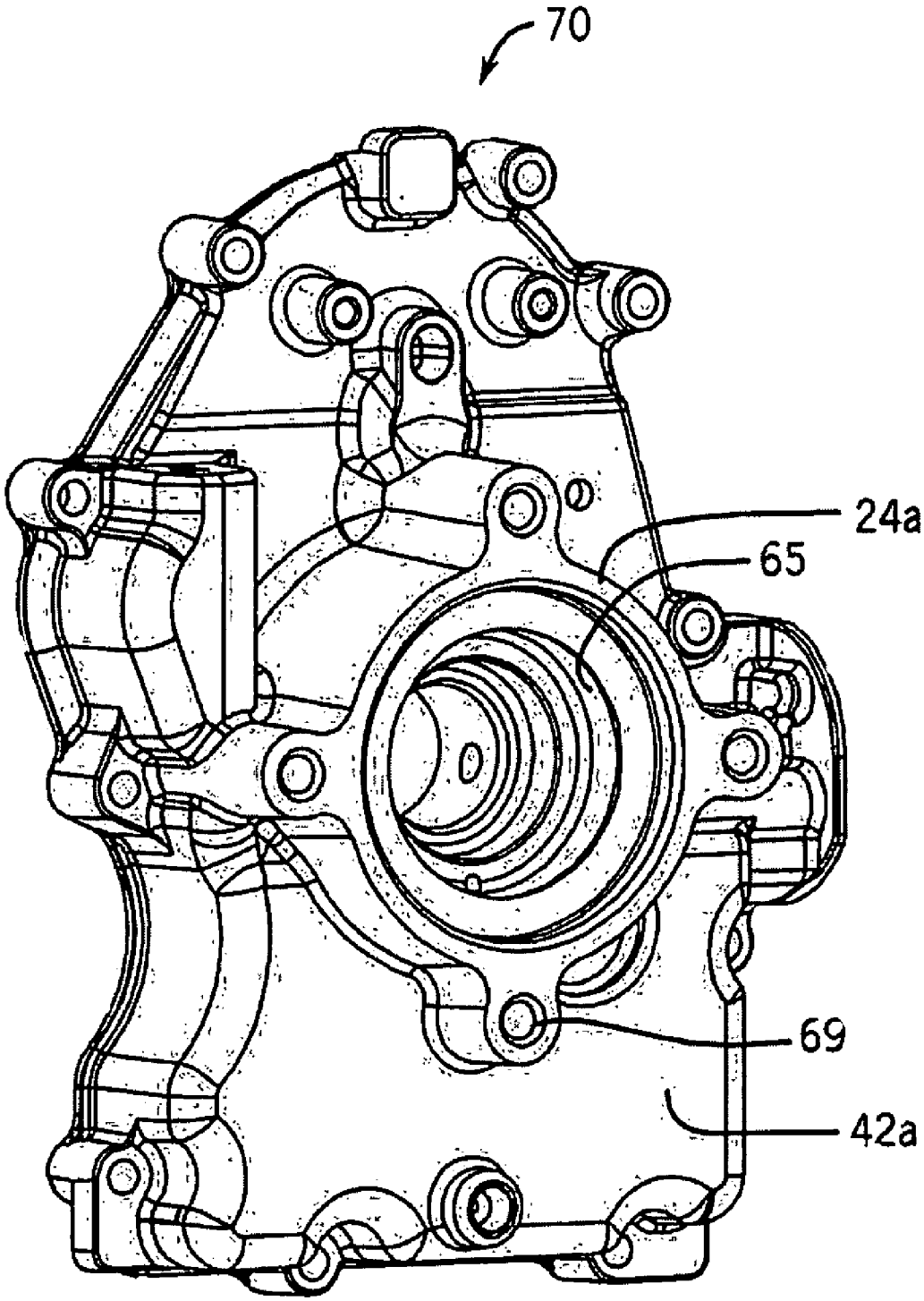
FIG. 5C is a perspective view of still another embodiment of the engine closure and adapter device, similar to that of FIG. 5B, in which the device again includes an integrally formed or integrated engine closure plate portion and an adapter plate portion.

FIGS. 5A-5C illustrates perspective views of three exemplary engine closure and adapter devices 50, 60 and 70, respectively. Referring to FIG. 5A, a perspective view of an embodiment of an engine closure and adapter device 50 is shown. The exemplary engine closure and adapter device 50 includes an adapter plate 24 that is secured to an engine closure plate 42. FIGS. 5B and 5C depict the exemplary engine closure and adapter devices 60 and 70, that each include integrally formed engine closure plate and adapter plate portions 42*a*, 24*a*, respectively. Additionally, FIG. 5A, similar to FIG. 3A, depicts the annular channel 43, whereas FIGS. 3B, 4A, 5B and 5C do not include the annular channel.

In at least some embodiments, the precise location of the passageway 40 (shown in FIGS. 3A-3B and 4A-4B) can vary depending on the configuration of the engine closure plate and adapter plate, although typically the passageway 40 is positioned adjacent to a low point in the drain cavity 44, as shown in FIGS. 3A-3B and 4A-4B. The closure and adapter device 60, 70 (FIGS. 5B-5C) having integral closure plate portion 42*a* adapter plate portion 24*a* provides a pre-assembly surface that is larger, and therefore provides added versatility in locating and positioning the aforementioned passageway and drain cavity.

With reference to FIGS. 3A and 5A, the annular channel 43, bearing 47, bearing passage 45, drain cavity 44, and passageway 40 are shown. Lubricating oil from the bearing passage 45 enters the annular channel 43 and provides a continuous supply of lubricating oil to the second oil passage 32 regardless of the rotational position of the crankshaft 21. Adjusting the depth of the annular channel 43 can increase or decrease the volume of lubricating oil that is available to the second oil passage 32. Therefore, the size of the annular channel 43 is at least in part dependent on the amount of lubricating oil desired to be received at the cavity 26.

Still referencing FIGS. 3A and 5A, the exemplary engine closure and adapter device 50 (FIG. 5A) is configured to be installed at least partially over the crankshaft 21 (FIG. 3A). In at least one embodiment the exemplary engine closure and adapter device 50 is secured to the crankcase 22 (e.g., as previously shown in FIG. 2) with fasteners, such as bolts, that are installed through mounting holes 57. Once the exemplary engine closure and adapter device 50 is in a secured position, the crankshaft 21 is preferably recessed inside the exemplary engine closure and adapter device 50. Further, the adapter plate 24 can include a plurality of securing points, such as adapter holes 56, and the engine closure plate 42 can include a plurality of securing points, such as threaded plate cavities 58 that can be formed integrally with the engine closure plate 42. Fasteners such as bolts (not shown), are used to secure the adapter plate 24 to the engine closure plate 42 via the adapter holes 56 and the plate cavities 58. Additionally, the adapter plate 24 can have a plurality of securing points such as threaded mount cavities 59 for securing a component such as the aforementioned hydraulic pump to the adapter plate 24 using a fastener such as a bolt. Further and although not shown, the adapter plate 24 can include protrusions or apertures suitable for assisting the alignment of the power transmitting element with an interfacing element (such as a spline of a hydraulic pump).

Still referencing FIGS. 3A and 5A, the exemplary engine closure and adapter device 50 can further have at least one component interface location 55 in the form of a bore that is substantially concentric with a PTO end. The component interface location 55 is typically machined into or formed integral with at least one of the adapter plate 24 and the engine closure plate 42. The component interface location 55 can provide an additional alignment and or securing point by providing a rigid guide for component insertion between the exemplary engine closure and adapter device 50 and a component attached therewith. Further, component interface locations 55 of various sizes may be used simultaneously on the exemplary engine closure and adapter device 50 to provide versatility for installing varying components.

With reference to FIG. 5B, engine closure and adapter device 60 includes the adapter plate portion 24*a* that is formed integrally with engine closure plate portion 42*a*. Additionally, the adapter plate portion 24*a* can have a plurality of securing points such as threaded mount cavities 69 for securing, with a fastener such as a bolt, a component such as the aforementioned hydraulic pump (not shown). With the engine closure plate and adapter plate portions 42*a* and 24*a* formed in an integral fashion, precise alignment of the power transmitting element with an interfacing element 29 (e.g., as shown in FIG. 3B) is more readily accomplished. Further, in contrast to FIGS. 3A and 5A and in accordance with at least some embodiments of the invention, the annular channel 43 of FIGS. 3A and 5A is absent. Instead, a bearing passage 45*a* extends through a bearing 47*a*, for example, so as to be situated adjacent an engine crankshaft.

With further reference to FIG. 5B, the exemplary engine closure and adapter device 60 is configured to be installed at least partially over a crankshaft (such as crankshaft 21 shown in FIGS. 4A and 4B). In at least some embodiments, the exemplary engine closure and adapter device 60 is secured to the engine (not shown) with a fastener, such as a bolt, that is situated in or through mounting holes 67. With the exemplary engine closure and adapter device 60 in a secured position, the crankshaft 21 is preferably recessed inside the exemplary engine closure and adapter device 60. Additionally, one or more securing points 69 are formed in the adapter plate portion 24*a* situated at least generally along a circumference in a radial direction from the component interface location 65. Securing points 69 can be used to secure a pump such as a hydraulic pump to the adapter plate portion 24*a*. It is contemplated that the precise number and spacing of the securing points can vary to convenience. For example, the points can be oriented generally along more than one circumference and in or along more than one radial direction. Alternatively, the securing points may be arranged in various other patterns (e.g., rectangular, triangular, octagonal, etc.), which are contemplated and considered within the scope of the present invention.

FIG. 5C depicts an engine closure and adapter device 70 that is similar to the engine closure and adapter device 60 shown in FIG. 5B, with the exception that the securing points 69 are situated farther from the component interface location 65 (e.g., in a respective radial direction) along the adapter plate portion 24*a*. Here again, although securing points 69 are shown in specific locations on the adapter plate portion 24*a* in FIGS. 5B and 5C, other locations can be suitable as necessitated by the device (e.g., its shape, mounting configuration, etc.) being attached thereto and such other locations or patterns for the securing points are again contemplated and considered within the scope of the present invention. Still further, other mounting mechanisms (e.g., a threaded or other rotationally securable component) capable of securing a device (e.g., a hydraulic pump) to the adapter plate portion 24*a* can be used.

Turning to FIGS. 5B and 5C, the exemplary engine closure and adapter devices 60 and 70 can also have one or more component interface locations 65 to aid in the alignment between the engine closure and adapter devices 60, 70 and a mating component attached thereto (such as a hydraulic pump). Here again, component interface locations 65 of various sizes may be used simultaneously on the exemplary engine closure and adapter devices 60 and 70 to provide versatility for installing varying components.

Figure 6B:
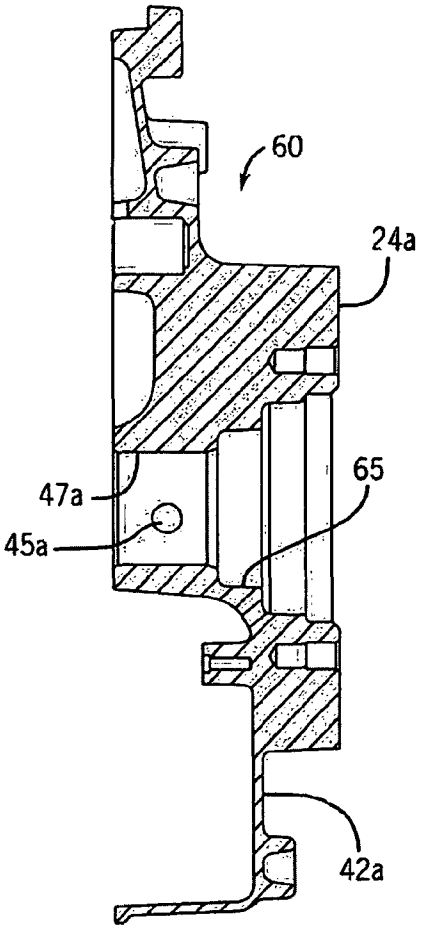
FIG. 6B is a sectional side view of the engine closure and adapter device taken along line 6B-6B of FIG. 6A.
Figure 6A:
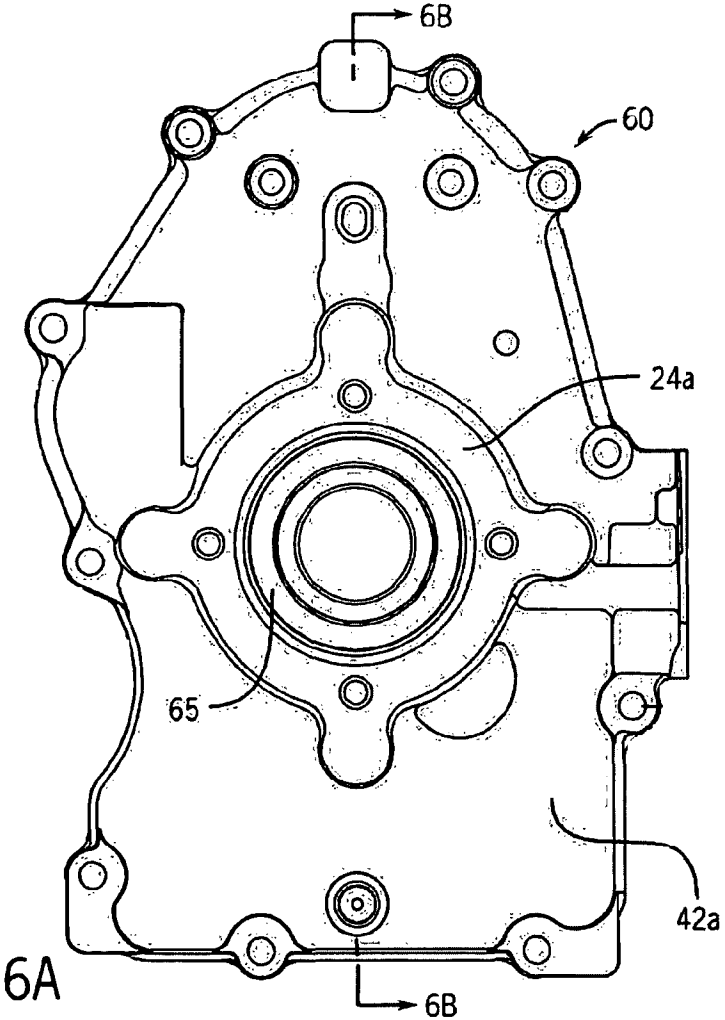
FIG. 6A is a front view of the engine closure and adapter device shown in FIG. 5B.

FIGS. 6A and 6B are front and sectional side views, respectively, of FIG. 5B, and show bearing 47*a*, bearing channel 45*a*, component interface locations 65 and engine closure and adapter device 60 further including adapter plate portion 24*a* and the engine closure plate portion 42*a*. In accordance with at least some embodiments of the invention, the component interface locations 65 take the form of a series of concentric circular recesses with varied depths that decrease in diameter as they are situated closer to the bearing 47*a* (e.g., as shown in FIG. 5B). Further, it has been contemplated that the component interface locations 65 can take various shapes other than circular, such as triangular or rectangular. More generally, it is contemplated and considered within the scope of the invention that the component interface locations (and any connecting components) may be sized and/or shaped to convenience. Further, it is contemplated that the component interface locations 65 can be machined into the engine closure and adapter device 50 after production, or alternatively, they can be formed simultaneously within the engine closure and adapter device 60 as part of a single casting.

It is noted that while the preceding descriptions group certain figures together, such description is provided to facilitate an understanding of the invention only, and should not be construed in a limiting sense. For example, the integral or integrated engine closure and adapter device 60 (e.g., FIG. 5B) can be utilized in conjunction with an assembly having the features illustrated in FIG. 3A (e.g., an annular channel), and similarly, the engine closure and adapter device 50 (e.g., as shown FIG. 5A) can be utilized in conjunction with an assembly having the features illustrated in FIGS. 4A and 4B.

In at least some embodiments, the precise location of the passageway 40 (FIGS. 3A-3B and 4A-4B) can vary depending on a number of criteria or factors. For example, the integrated engine closure and adapter plate device 60 (e.g., FIG. 5B) can allow for more efficient positioning of the passageway 40 as compared to the secured engine closure and adapter plate device 50 (e.g., as shown in FIG. 5A), because there are no discontinuous portions to accommodate. Further, in at least some embodiments, the passageway 40 is positioned adjacent to a low point in the drain cavity 44, as shown in FIGS. 3A-3B and 4A-4B.

End use applications for the above invention include, but are not limited to, low cost utility engines (e.g., twin cylinder, single cylinder, multiple cylindered, etc.). Engines contemplated for use in the present invention include Command® Engines, also manufactured by Kohler, Co., located in Kohler, Wis.

It is specifically intended that the present invention not be limited to the embodiments and illustrations contained herein, but include modified forms of those embodiments including portions of the embodiments and combinations of elements of different embodiments as come within the scope of the following claims.

We claim:

1. A lubrication system for use with an engine, the system comprising:

a bearing; and a crankshaft in operational association with the bearing, the crankshaft having an end that includes a cavity having a power transmitting element, the cavity capable of receiving and engaging a mating mechanism so as to transmit power thereto, the crankshaft further including a first oil passage that is substantially centrally disposed within the end and a second oil passage that extends from a bearing into the crankshaft such that the first oil passage intersects the second oil passage;

wherein lubricating oil is circulated from the bearing to the crankshaft through the second oil passage and the first oil passage, and then to the cavity so as to lubricate the power transmitting element.

2. The system of claim 1 further comprising an engine closure and adapter device, wherein the engine closure and adapter device includes an adapter plate secured to an engine closure plate.

3. The system of claim 1 wherein the first oil passage includes a flow reducing orifice having a removable plug secured therein to control flow of lubrication oil such that lubricating oil flows through the plug and into the cavity.

4. The system of claim 1 wherein the bearing includes an annular channel that is situated to connect a bearing passage and the second oil passage.

5. The system of claim 1 wherein the bearing has a bearing passage that is substantially aligned with the second oil passage at least once during each complete revolution of the crankshaft.

6. The system of claim 1 further comprising an engine closure and adapter device, wherein the engine closure and adapter device includes an integrally formed engine closure plate portion and adapter plate portion, with the engine closure and adapter device being capable of interfacing with another mechanism.

7. The system of claim 6 wherein the engine closure and adapter device at least partially encloses the power take-off (PTO) end, and the engine closure and adapter device has a passageway situated therein to drain oil from the enclosed portion of the power take-off (PTO) end.

8. A method for lubricating an engine power transmitting element, the method comprising:

providing a lubrication system, the lubrication system including:

a bearing;

a crankshaft in operational association with the bearing, the crankshaft having a power take-off (PTO) end with a cavity having a surface with a power transmitting element, the cavity capable of receiving a mating mechanism to transmit power thereto, the crankshaft further including a first oil passage that is centrally disposed within the PTO end and a second oil passage that intersects the first oil passage; and circulating oil, such that lubricating oil flows from the hearing through the second oil passage and the first oil passage, and then to the cavity, thereby lubricating the power transmitting element.

9. The method of claim 8, further including controlling the flow of lubrication oil using a flow reducing orifice having a removable plug secured therein, where lubricating oil flows through the plug and into the cavity.

10. The method of claim 8, further including substantially aligning a bearing passage in the bearing with the second oil passage once during each complete revolution of the crankshaft.

11. The method of claim 10, wherein the providing includes the second oil passage extending radially inward in the crankshaft from the bearing and intersecting the first oil passage at about a 90 degree angle.

12. The method of claim 8, wherein the circulating further comprises lubricating an interfacing element of a mating mechanism that engages the power transmitting element of the crankshaft.

13. The method of claim 12 wherein the providing further includes at least partially enclosing the power take-off (PTO) end with an engine closure and adapter device.

14. A system for lubricating splines on an engine crankshaft, the system comprising:

a bearing;

a crankshaft in operational association with the bearing, the crankshaft having a power take-off (PTO) end with a cavity, the cavity having a surface with either internal or external splines, the cavity capable of receiving a mating mechanism with a surface having complementary splines, the crankshaft further including a first oil passage that is substantially centrally disposed within the PTO end and a second oil passage that intersects the first oil passage;

an engine closure and adapter device at least partially enclosing the power take-off (PTO) end; and a pump mechanism for circulating oil to the bearing through a bearing passage such that lubricating oil flows from the bearing to the crankshaft through the second oil passage and the first oil passage, and then to the cavity.

15. The system of claim 14 wherein the engine closure and adapter device includes an adapter plate secured to an engine closure plate.

16. The system of claim 14 wherein the first oil passage includes a flow reducing orifice having a removable plug secured therein, where lubricating oil flows through the plug and into the cavity.

17. The system of claim 14 wherein the engine closure and adapter device has a passageway formed therein to provide a return oil path from a drain cavity to the pump mechanism.

18. The system of claim 14 wherein the second oil passage extends radially inward in the crankshaft from the bearing intersecting the first oil passage at about a 90 degree angle, and the second oil passage aligns with the bearing passage at least once per crankshaft revolution.

19. The system of claim 14, wherein the second oil passage is capable of substantially aligning with the bearing passage at least once during each complete revolution of the crankshaft.

20. The system of claim 15 wherein the engine closure and adapter device includes an integrally formed engine closure plate portion and adapter plate portion, with the engine closure and adapter device being capable of interfacing with another mechanism.

21. The system of claim 20 wherein the lubricating oil arriving at the cavity proceeds outwardly to inwardly-facing surfaces of internal splines and serves to lubricate both the internal splines and any complementary external splines of any mating mechanism that is inserted into and meshed with the internal splines.

22. A method for lubricating an engine power transmitting element, the method comprising:

providing a lubrication system, the lubrication system including:

a bearing having a bearing passage;

a crankshaft in operational association with the bearing, the crankshaft having a power take-off (PTO) end with a cavity having a surface with a power transmitting element, the cavity capable of receiving a mating mechanism to transmit power thereto, the crankshaft further including a first oil passage that is centrally disposed within the PTO end and a second oil passage that intersects the first oil passage; and an engine closure plate or enclosure plate portion adjacent the PTO end such that the PTO end is at least partially enclosed by the engine closure plate or enclosure plate portion, thereby forming at least a drain cavity; and circulating oil to the bearing and the crankshaft using an oil lubrication pumping mechanism such that lubricating oil flows through the bearing passage to the bearing to the second oil passage and the first oil passage, and then to the cavity, thereby lubricating the power transmitting element.

23. The method of claim 22 wherein the providing further includes the first oil passage having a flow reducing orifice with a removable plug secured therein to control flow of lubrication oil, and wherein the circulating includes lubricating oil flowing through the plug and into the cavity.

24. The method of claim 22, wherein the providing further includes providing an adapter plate that is attached to the enclosure plate, or an adapter plate portion that is integrally formed with the engine closure plate portion, to form an engine closure and adapter device.

25. The method of claim 24, wherein the providing further includes at least one component interface location situated in the engine closure and adapter device.

26. The method of claim 25, wherein the providing further includes the component interface location being formed integral with the engine closure and adapter device.

27. The method of claim 22 wherein a passageway is formed in or adjacent to the engine closure plate or engine closure plate portion and wherein the circulating includes returning oil, via the passageway, from the drain cavity to a pump mechanism.

28. The method of claim 22 wherein lubricating oil arriving at the cavity lubricates both internal splines and any interfacing element of any mating mechanism that is inserted into and meshed with the internal splines.

29. The method of claim 28 further including draining the lubricating oil from the cavity into a drain cavity and further draining the lubricating oil from the drain cavity through a passageway located in adjacent to the enclosure plate or enclosure plate portion.

30. The method of claim 29 further comprising rotating the crankshaft to substantially align the second oil passage with the bearing passage at least once per crankshaft revolution, such that the second oil passage extends radially inward in the crankshaft from the bearing.

* * * * *